US011388502B1

(12) United States Patent
Parry

(10) Patent No.: US 11,388,502 B1
(45) Date of Patent: Jul. 12, 2022

(54) IN-EAR DEVICE WITH PERSONALIZED AESTHETICS

(71) Applicant: Strand Industries, LLC, Woodland Hills, CA (US)

(72) Inventor: Ryan Parry, Los Angeles, CA (US)

(73) Assignee: Strand Industries, LLC, Los Angeles, CA (US)

( * ) Notice: Subject to any disclaimer, the term of this patent is extended or adjusted under 35 U.S.C. 154(b) by 0 days.

(21) Appl. No.: 17/685,885

(22) Filed: Mar. 3, 2022

(51) Int. Cl.
*H04R 1/10* (2006.01)

(52) U.S. Cl.
CPC ..... *H04R 1/1016* (2013.01); *H04R 1/1041* (2013.01); *H04R 1/1058* (2013.01); *H04R 1/1083* (2013.01)

(58) Field of Classification Search
CPC .. H04R 1/1016; H04R 1/1041; H04R 1/1058; H04R 1/1083
See application file for complete search history.

(56) References Cited

U.S. PATENT DOCUMENTS 8,875,542 B2 11/2014 Severs
9,877,552 B2 1/2018 Petrosyan
2004/0055332 A1 3/2004 Hartgrove
2013/0233017 A1 9/2013 Nevatia
2014/0338397 A1* 11/2014 Andreini, III ..... A44C 25/002 63/1.14
2020/0314567 A1* 10/2020 Shriner ..... H04R 25/65
2022/0159392 A1* 5/2022 Newton ..... H04R 25/402

* cited by examiner

*Primary Examiner* — Simon King
(74) *Attorney, Agent, or Firm* — Diament Patent Law, P.C.; Adam Diament

(57) ABSTRACT

An in-ear device is disclosed that comprises an earbud and a decorative article. A head portion of the earbud has an ear canal insert portion, first end of which is coupled with an ear plug. A faceplate of the earbud having first planar region which is traversely extended from second end of the ear canal insert portion to an area that is proximate to outer boundary of the first planar region. A second planar region of the faceplate corresponds to mounting region having recess portion adapted to house first metal coupling plate. The decorative article is detachable from the mounting region and has second metal coupling plate. At least one of first metal coupling plate and second metal coupling plate is magnetic material. The first metal coupling plate is complementarily sized and shaped to magnetically couple with second metal coupling plate when placed in proximity to first metal coupling plate.

20 Claims, 6 Drawing Sheets

IN-EAR DEVICE WITH PERSONALIZED AESTHETICS

CROSS-REFERENCE TO RELATED APPLICATIONS

None.

FIELD OF THE DISCLOSURE

The present invention relates to in-ear devices, and more specifically, to an in-ear device with personalized aesthetics.

BACKGROUND OF THE INVENTION

Recent decade has witnessed an increased demand and popularity for in-ear device usage. Such in-ear devices, such as earbuds, are designed to be inserted in an ear canal to protect user's ears from loud noises, foreign bodies, dust and/or excessive wind. Such in-ear devices find utility in a myriad of use cases, for example, demolition and construction sites, airports, concerts, sporting events, biking, or even sleeping and studying as well to name a few.

However, most of the options for the in-ear devices limit the users to very selective designs, fixed accessories (such as jewels), and monochrome colors and do not provide any option of personalizing the devices. Thus, users have no choice but to collect different colored or accessorized in-ear devices to meet each wardrobe, home decor, and social event requirement, thereby increasing the user's expenditure manifold. Additionally, the quest of the user to find a right colored or accessorized in-ear device to match the mood or the overall look may also be very cumbersome specially when the user is running short of time. Furthermore, safekeeping of remaining sets of in-ear device after usage when one set of in-ear device is worn, may become a time-consuming task for the user.

Still, there remains a continuing need for improved in-ear devices with personalized aesthetics.

BRIEF SUMMARY OF THE PRESENT INVENTION

The present invention provides an in-ear device with personalized aesthetics. The personalized aesthetics is provided by a detachable decorative article that is magnetically coupled with a faceplate of an earbud of the in-ear device.

In one aspect of the present invention, the invention provides an in-ear device comprising an earbud and a decorative article. A head portion of the earbud has an ear canal insert portion and an ear plug. A first end of the ear canal insert portion is coupled with the ear plug. A faceplate of the earbud has a first planar region and a second planar region. The first planar region is traversely extended from a second end of the ear canal insert portion to an area that is proximate to an outer boundary of the first planar region. The second planar region of the faceplate corresponds to a mounting region that has a recess portion adapted to house a first metal coupling plate. The decorative article is detachable from the mounting region. The decorative article has a second metal coupling plate. At least one of the first metal coupling plate and the second metal coupling plate is a magnetic material. The first metal coupling plate in the recess portion is complementarily sized and shaped to magnetically couple with the second metal coupling plate of the decorative article when placed in proximity to the first metal coupling plate of the faceplate of the earbud.

In accordance with an embodiment, the first end of the ear canal insert portion may be coupled with the ear plug. The first end may have an attenuation filter disposed proximate to an ear drum of a user. The attenuation filter may be adapted to control a sound pressure level (SPL) of incoming sound waves reaching the ear drum through a sound channel based on one or more parameters of the attenuation filter. The one or more parameters of the attenuation filter comprise a type of material of a filter medium of the attenuation filter, a structure of the filter medium, flexibility of a diaphragm member, and pore size of the filter medium.

In accordance with an embodiment, wherein the attenuation filter generates a zero attenuation effect when the SPL of the incoming sound waves is below a first threshold value.

In accordance with an embodiment, wherein the attenuation filter generates a full attenuation effect when the SPL of the incoming sound waves is above a second threshold value.

In accordance with an embodiment, wherein the attenuation filter generates a partial attenuation effect when the SPL of the incoming sound waves is between the first threshold value and the second threshold value.

In accordance with an embodiment, the head portion houses an electronics system communicatively coupled with external devices. The faceplate of the earbud protrudes out and snuggly fits in cavum concha of the ear.

In accordance with an embodiment, the decorative article is a gem stone, a jewel, a metallic object, or other magnetic artifact.

In accordance with an embodiment, a clicking sound is generated as the second metal coupling plate of the decorative article is magnetically coupled to the first metal coupling plate.

In accordance with an embodiment, the ear plug corresponds to a resilient membrane tip. The size and shape of the ear plug is substantially deformed and subsequently expanded resiliently to fit different ear canal sizes and shapes.

In accordance with an embodiment, a plate size and a plate shape of the first metal coupling plate is based on a shape and size of the recess portion.

In another aspect of the invention, a method is provided for an in-ear device with personalized aesthetics. The method comprises detaching a first decorative article from a faceplate of an earbud of the in-ear device by forcibly sliding the first decorative article laterally along magnetically coupled surfaces of the first decorative article and the faceplate. A first magnetically coupled surface corresponds to a first metal coupling plate housed in a recess portion of a second planar region of the faceplate. A second magnetically coupled surface corresponds to a second metal coupling plate at base of the first decorative article. At least one of the first metal coupling plate and the second metal coupling plate is a magnetic material. The method further comprises attaching a second decorative article to the faceplate of the earbud when the second decorative article is placed in proximity to the first metal coupling plate. The first metal coupling plate is magnetically coupled with a third metal coupling plate of the second decorative article.

In accordance with an embodiment, the method further comprises controlling the SPL of incoming sound waves reaching an ear drum through a sound channel based on one or more parameters of an attenuation filter.

In accordance with an embodiment, the method further comprises generating a clicking sound when one of the second metal coupling plate of the first decorative article or the third metal coupling plate of the second decorative article is magnetically coupled to the first metal coupling plate.

DETAILED DESCRIPTION OF EMBODIMENTS

Figure 1A:
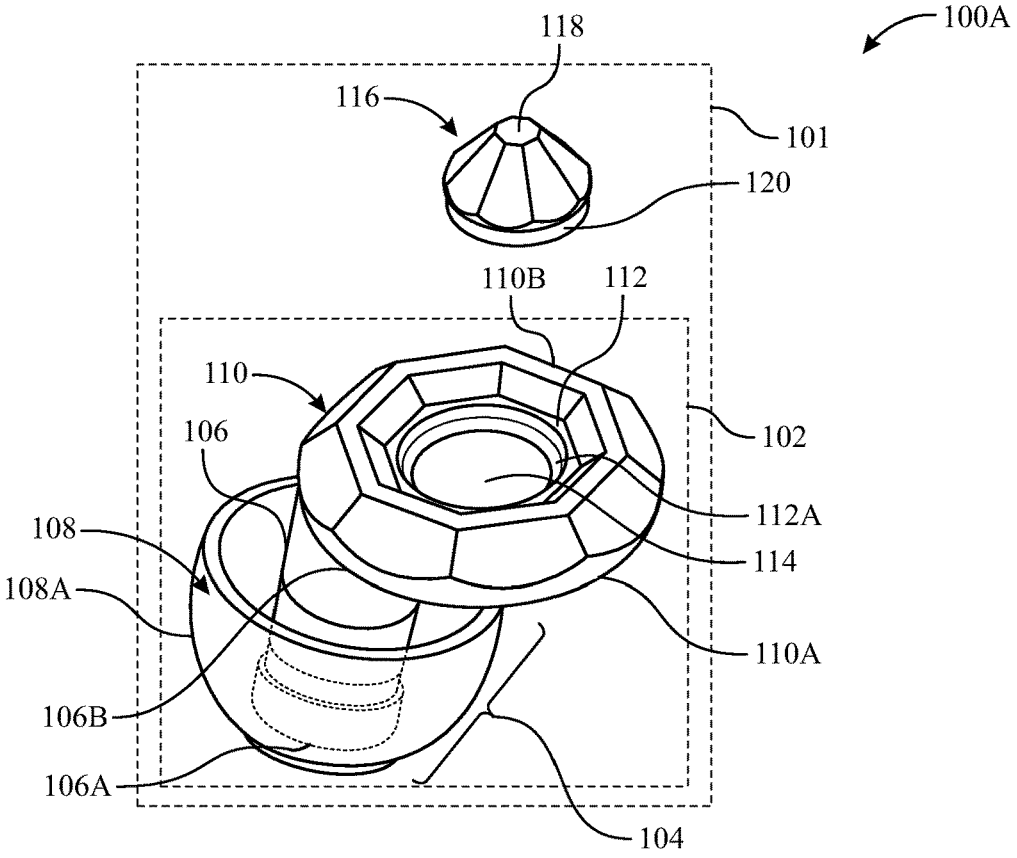
FIG. 1A depicts a first perspective view of an in-ear device, according to an embodiment of the present disclosure.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein. All patents, patent applications and non-patent literature cited through this application are hereby incorporated by reference in their entireties.

Figure 1B:
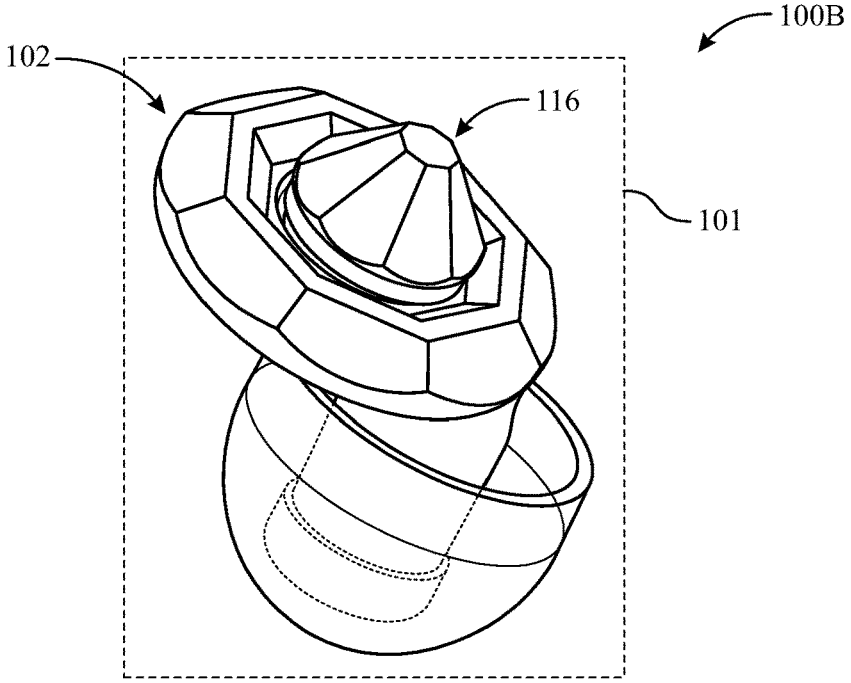
FIG. 1B depicts a second perspective view of an in-ear device, according to an embodiment of the present disclosure.

Turning to the Figures, FIGS. 1A and 1B depicts a first perspective view 100A and a second perspective view 100B respectively, of an in-ear device 101, according to an embodiment of the present disclosure. More specifically, the first perspective view 100A, as depicted in FIG. 1A, corresponds to an unassembled view of the in-ear device 101 and the second perspective view 100B, as depicted in FIG. 1B, corresponds to an assembled view of the in-ear device 101.

The in-ear device 101, as depicted in FIGS. 1A and 1B, includes an earbud 102 and a first decorative article, such as a decorative article 116, according to an embodiment of the present disclosure. The earbud 102 further includes a head portion 104, an ear canal insert portion 106 (having a first end 106A and a second end 106B), and an ear plug 108. The earbud 102 further includes a faceplate 110 (having a first planar region 110A and a second planar region 110B), a mounting region 112 having a recess portion 112A, and a first metal coupling plate 114. The decorative article 116 is depicted to include an ornamental part 118 and a second metal coupling plate 120. The recess portion 112A may be sized to have a depth such that the decorative article 116 protrudes above the planar region 110B, is flush with the planar region 110B, or substantially flush with the planar region 110B.

The earbud 102 may correspond to an in-ear device that is inserted in an ear canal of a user to protect the user's ears from loud noises and various environmental factors. The loud noises may be caused by explosions or bursts and comprises a mixture of sound wave frequencies of varying intensity. These disturbing frequencies may be in both the high and low frequency bands and the sound pressure is sufficient enough to cause hearing problems. Examples of the environmental factors may include, but are not limited to, humidity, foreign bodies, dust or high speed wind.

In accordance with an embodiment, the earbud 102 may be used by the user while at work (for example, demolition or construction sites, factories with heavy and noisy equipment and machines, airports, shooting ranges), whilst traveling, during leisure activities, or even at home to control undesired noise and sounds of high sound pressure level. The earbud 102 may attenuate or block the sounds of high sound pressure level, and thus protects the user from various physical and psychological ailments as well. Examples of physical ailments may include noise-induced hearing loss, hyperacusis (sound sensitivity), tinnitus (ringing of the ears), and the like. Examples of psychological ailments may include disturbed concentration and attention span, sleep disorders, distraction from other hazards, induced stress, and the like. Furthermore, the earbud 102 may also protect the user's ears against various infections and inflammations caused due to the environmental factors.

In accordance with an embodiment, though not shown in FIG. 1A, the earbud 102 may be fitted with an electronics system comprising suitable electronic components, such as a microphone, a speaker, a wireless communications module, a battery, and a control circuit. In such an embodiment, the speaker may be disposed near the first end 106A of the ear canal insert portion 106. The microphone, along with rest of the electronic components, may be disposed near the second end 106B of the ear canal insert portion 106. In accordance with various embodiments, the electronics system may be fixed inside, mounted on, and/or embedded in or on the body of the ear canal insert portion 106.

In various exemplary scenarios, the wireless communications module in the earbud 102 may be configured to establish a communication with external devices, such as another in-ear device, a transceiver on a mobile phone, a remote data server located on a remote computing device, and a cloud computing device, using a series of different communications protocols. The electronics system in the earbud 102 may be configured to receive sound data from the external devices and may render the sound data through the speaker. In accordance with another embodiment, the electronics system may further include a data storage unit due to which the earbud 102 may be used as a music player that may retrieve sound data from the data storage unit and play the sound data through the speaker.

In accordance with an embodiment, the earbud 102 may be fabricated by any suitable polymer molding technique, such as by injection molding thereof. In accordance with another embodiment, the earbud 102 may be fabricated by using a 3D printing technology, as described in detail in FIG. 4.

In accordance with an embodiment, the material used for the earbud 102 may be plastic that may provide a non-malleable, economical, and sturdy structure to the earbud 102. In accordance with other embodiments, the material used for the earbud 102 may be rigid polymers, such as acrylonitrile butadiene styrene (ABS), polycarbonate (PC), or PC/ABS blends or other relatively hard materials to form the structure to the earbud 102.

The head portion 104 may include the ear canal insert portion 106 and the ear plug 108. The first end 106A of the ear canal insert portion 106 may be coupled with the ear plug 108. The first end 106A of the ear canal insert portion 106 may include a filter, such as an attenuation filter depicted in FIG. 3B, that may be disposed proximate to an ear drum of the user.

In accordance with an embodiment, the ear canal insert portion 106 may be a solid portion that may substantially block incoming sound waves emitted by various ambient sources. In accordance with another embodiment, the ear canal insert portion 106 may be hollow so as to substantially receive incoming sound waves which are further received by the ear drum of the user. The first end 106A may be a tip portion of the ear canal insert portion 106 proximate to the ear drum and the second end 106B of the ear canal insert portion 106 may be a distil portion away from the ear drum of the user.

The ear plug 108 may be a sleeve or a flange 108A that corresponds to a resilient membrane cap integrated with a core. A hollow space between the inner walls of the flange 108A and the core may allow the flange 108A to freely compress and elongate for conforming to an ear canal of the user. Thus, the size and shape of the ear plug 108 is substantially deformed and subsequently expanded resiliently to fit different ear canal sizes and shapes. The core may be generally round and may comprise a channel that receives the first end 106A, i.e. the tip portion, of the ear canal insert portion 106. The channel of the core and the first end 106A of the ear canal insert portion 106 may be attached to each other via one or more of friction fitting, adhesive bonding, and ultrasonic welding. The outer circumferential surface of the flange 108A may be a streamlined curved design that generally fills (closes off) the ear canal of the user and tends to block the ambient sound when worn by the user.

The soft and resilient material of the ear plug 108 may enhance the user comfort during use and retain the earbud 102 in the ear for extended time periods, even while doing rigorous activities, such as running or during a workout. In accordance with an embodiment, the ear plug 108 may be formed of a resilient polymer, such as silicone rubber, that may provide the necessary Shore A Durometer values. Other examples may include, but not limited to, vinyl, elastomers, neoprene, and other hypoallergenic synthetic rubber. In an exemplary scenario, the ear plug 108 may be formed of a material having a Shore A durometer hardness value between 10 and 30 or between 15 and 25.

In accordance with an embodiment, the ear plug 108 may be configured in a manner to induce gaps between the earbud 102 and the ear canal of the ear. Such gaps may be provided to lower sound pressure in the ear canal, and allow ambient sounds to reach the user's eardrum. Thus, the user wearing the earbud 102 may continue to hear ambient sounds in a natural manner. Further, the earbud 102 not touching many points on the ear canal increases user comfort and provides better heat transfer. Thus, the user can wear the earbud 102 for extended periods of time. In accordance with an embodiment, when it is desirable to hear the ambient sound, the flange 108A may have one or more openings formed therein.

In accordance with an embodiment, the cross-sectional area of the ear canal insert portion 106 remains same but the cross-sectional area of the ear plug 108 may vary from user to user.

Thus, the size of the ear plug 108 should be carefully selected by the user for maximal comfort and longer retention.

The faceplate 110 may correspond to an external structure having the first planar region 110A that is traversely extended from the second end 106B of the ear canal insert portion 106 to a defined area. In accordance with an embodiment, the defined area may be proximate to the outer boundary of the first planar region 110A. In other words, the defined area may be away from the centre of the first planar region 110A. As the earbud 102 is worn by the user in the ear canal, the faceplate 110 protrudes out and snuggly fits in the cavum concha of the ear. In accordance with an embodiment, the shape of the faceplate 110 may be a regular shape, such as a circular shape, that makes the earbud 102 a compact and comfortable in-ear wearable device.

The second planar region 110B of the faceplate 110 may correspond to a mounting region 112. The mounting region 112 may further correspond to a shallow depression of an area of the second planar region 110B of the faceplate 110 bounded by a regular closed boundary, such as a circular-shaped boundary. The mounting region 112 may have another indented area that corresponds to the recess portion 112A. The recess portion 112A may be adapted to house the first metal coupling plate 114. In accordance with an embodiment, the first metal coupling plate 114 may be adhesively fixed (for example, by Epoxy) to the surface of the recess portion 112A. The shape and size of the recess portion 112A must be same as the shape and size of the first metal coupling plate 114.

In accordance with an embodiment, as shown in FIGS. 1A and 1B, the first planar region 110A and the second planar region 110B of the faceplate 110 may have artistic indentations and cut-outs that enhances the overall appearance of the faceplate 110. Both of the first planar region 110A and the second planar region 110B mate with each other and form an edge that corresponds to an outer boundary of the faceplate 110. The shape of the faceplate may be any regular shape, such as circular shape. In various embodiments, the edge may be a double bevelled blunt edge, a rounded convex edge, a full bullnose edge, a rounded edge, or other such edge that is rounded and blunt to provide a safe and comfortable in-ear wearable device.

The ornamental part 118 of the decorative article 116 may correspond to a jewel, a gem stone, a metallic object, a metallic medallion, a magnetic artifact or a composite ornamentation that may integrate a gem with a metallic setting. The second metal coupling plate 120 may be adhesively fixed (for example, by Epoxy) to the bottom surface of the ornamental part 118 of the decorative article 116. The second metal coupling plate 120 of the decorative article 116 is complementarily sized and shaped to be magnetically attracted and secured by the first metal coupling plate 114 of the recess portion 112A when placed in proximity to the recess portion 112A. The first metal coupling plate 114 and the second metal coupling plate 120 may correspond to a magnetic fastening assembly.

In accordance with an embodiment, both of the first metal coupling plate 114 and the second metal coupling plate 120 may be formed of magnetic materials as planar magnets, for example a first magnet and a second magnet respectively, having surfaces of opposite magnetic polarities facing each other. In accordance with one arrangement, a first surface of the first magnet which is adhesively fixed to the surface of the recess portion 112A, may be the south pole of the first magnet while the opposed second surface is its north pole. Accordingly, a first surface of the second magnet which is adhesively fixed to the bottom surface of the decorative article 116, may be the north pole of the second magnet while the opposed second surface is its south pole. Thus, the first surfaces of both the first and the second magnets are adhesively affixed to the recess portion 112A and bottom surface of the decorative article 116 respectively.

Accordingly, the second surfaces of both the first and the second magnets of opposite magnetic polarities face each other. In such arrangement, the first metal coupling plate 114 of the earbud 102 (with the first magnet) and the decorative article 116 (with the second magnet) may be magnetically coupled when placed in proximity. A clicking sound may be generated as the two metal coupling plates of the decorative article 116 and the faceplate 110 are magnetically coupled with each other. The assembled view of the in-ear device 101 is depicted as the second perspective view 100B in FIG. 1B.

Alternatively, a reverse arrangement, may also be accommodated, without any deviation from the scope of the disclosure. The reverse arrangement may correspond to the second surfaces of both the first and the second magnets adhesively affixed to the recess portion 112A and bottom surface of the decorative article 116 respectively. Accordingly, the first surfaces of both the first and the second magnets of opposite magnetic polarities face each other for magnetic coupling.

In accordance with another embodiment, the first metal coupling plate 114 may be a planar magnet and the second metal coupling plate 120 may be a flat armature. The second metal coupling plate 120 may be magnetically joined and secured on the first metal coupling plate 114 when voluntarily mounted on the first metal coupling plate 114 or placed in vicinity of the first metal coupling plate 114. In accordance with another embodiment, the respective position of the first magnet and the armature may be exchanged, without any deviation from the scope of the disclosure.

In the assembled position, as depicted in FIG. 1B, the mounting region 112 and the recess portion 112A will prevent any accidental or unintentional lateral motion leading to sliding off of the decorative article 116. Thus, both the earbud 102 and the decorative article 116 will be kept firmly in place by the strong magnetic forces between the first metal coupling plate 114 (i.e. the magnet) and the second metal coupling plate 120 (i.e. the magnet or the armature). The separation will be possible only when the user forcibly slides the decorative article 116 laterally along the magnetically coupled surfaces of the decorative article 116 and the faceplate 110 at which both of the decorative article 116 and the faceplate 110 are joined. Such a lateral sliding action reduces the magnetic resistance and then the decorative article 116 may be detached easily. Accordingly, the hazard of accidentally losing the decorative article 116 from the in-ear device 101 reduces substantially.

In accordance with an embodiment, the recess portion 112A may be provided with a tiny wedge (not shown) on its periphery permitting the user to use a pin, fingertip or fingernail and pull the decorative article 116 in an outward direction from magnetically coupled surfaces at which the two parts are joined. Thus, the decorative article 116 is replaceable as it is removable from the recess portion 112A of the mounting region 112 of the earbud 102. As described above, alteration in the arrangement, shapes and sizes of the parts may be made, the respective position of magnet and armature may be exchanged, two magnets may be used, and the same magnetic assembly for other decorative articles (similar to the magnetic assembly of the decorative article 116) may be realized wherever an interchangeability of decorative articles is desired, without departing from the scope of the disclosure.

Figure 2A:
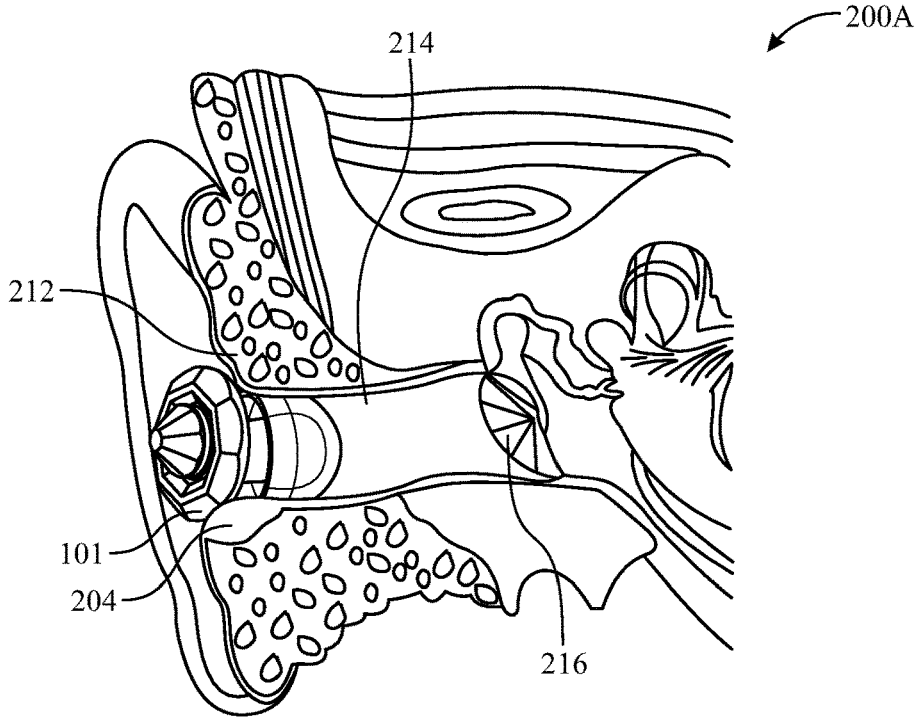
FIG. 2A depicts a cut-out view of an ear of a user wearing an in-ear device, according to an embodiment of the present disclosure.
Figure 2B:
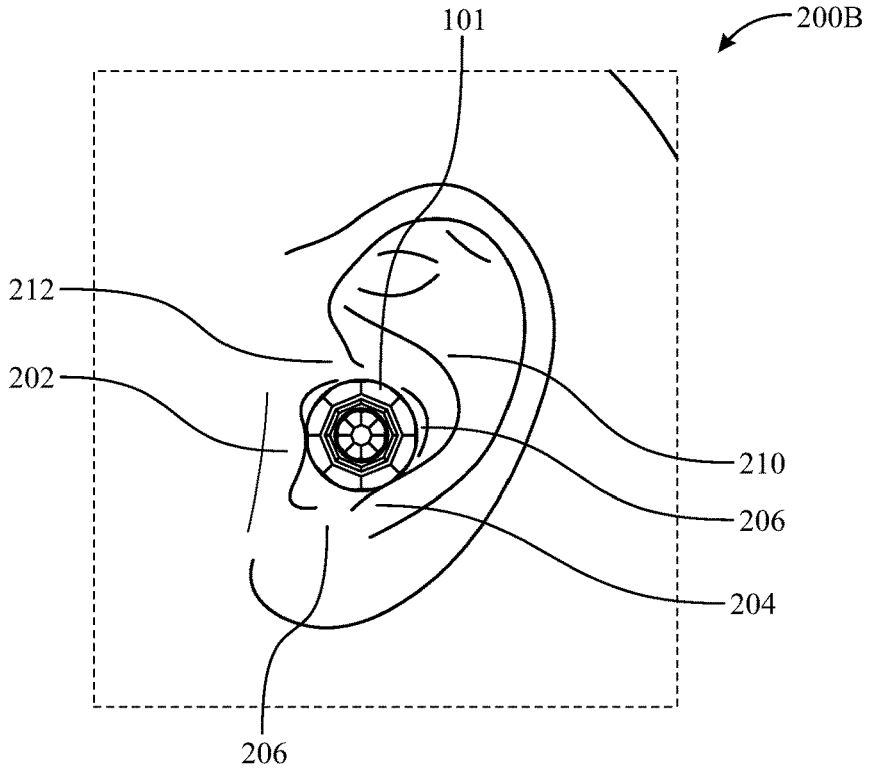
FIG. 2B depicts a side view of an ear of a user wearing an in-ear device, according to an embodiment of the present disclosure.

FIGS. 2A and 2B depict a cut-out view 200A and a side view 200B respectively, of an ear 200 of a user wearing the in-ear device 101, according to an embodiment of the present disclosure. The anatomy of the ear 200 includes the tragus 202, antitragus 204, the cavum of concha 206, the intertragic notch 208 located between the tragus 202 and the antitragus 204, the anti-helix 210, the crus of helix 212, an ear canal 214, and an ear drum 216. The cavum of concha 206 forms a pitch-like recess within the concha. The crus of helix 212 extends as a land into the cavum of concha 206.

As depicted in FIG. 2A, the earbud 102 is designed to be inserted in the ear canal 214 such that the first end 106A, i.e. the tip portion, of the ear canal insert portion 106 is disposed proximate to the ear drum 216. As known in the medical art, the typical length of the ear canal 214 may vary between 27 mm and 35 mm measured along a curved centre axis, as some users have shallow ear canals while other users have deep ear canals. Mostly, a distance between 8 to 12 mm may be considered as an optimal distance of the first end 106A of the ear canal insert portion 106 from the ear drum 216.

As the earbud 102 is inserted in the ear canal 214, the ear plug 108 and the ear canal insert portion 106 of the head portion 104 rests in the ear canal 214 along the length of the ear canal 214. Further, the faceplate 110 protrudes out and snuggly fits in the cavum of concha 206 of the ear 200 substantially orthogonal to the length of the ear canal 214, as clearly depicted in FIGS. 2A and 2B. The faceplate 110 of the earbud 102 resides in the cavum of concha 206 and secured majorly by the tragus 202 and the antitragus 204, and partially by the crus of helix 212 of the ear 200 of the user. While changing or removing by hand, the user may easily hold the faceplate 110 and pull the in-ear device 101 out from the ear 200.

Figure 6:
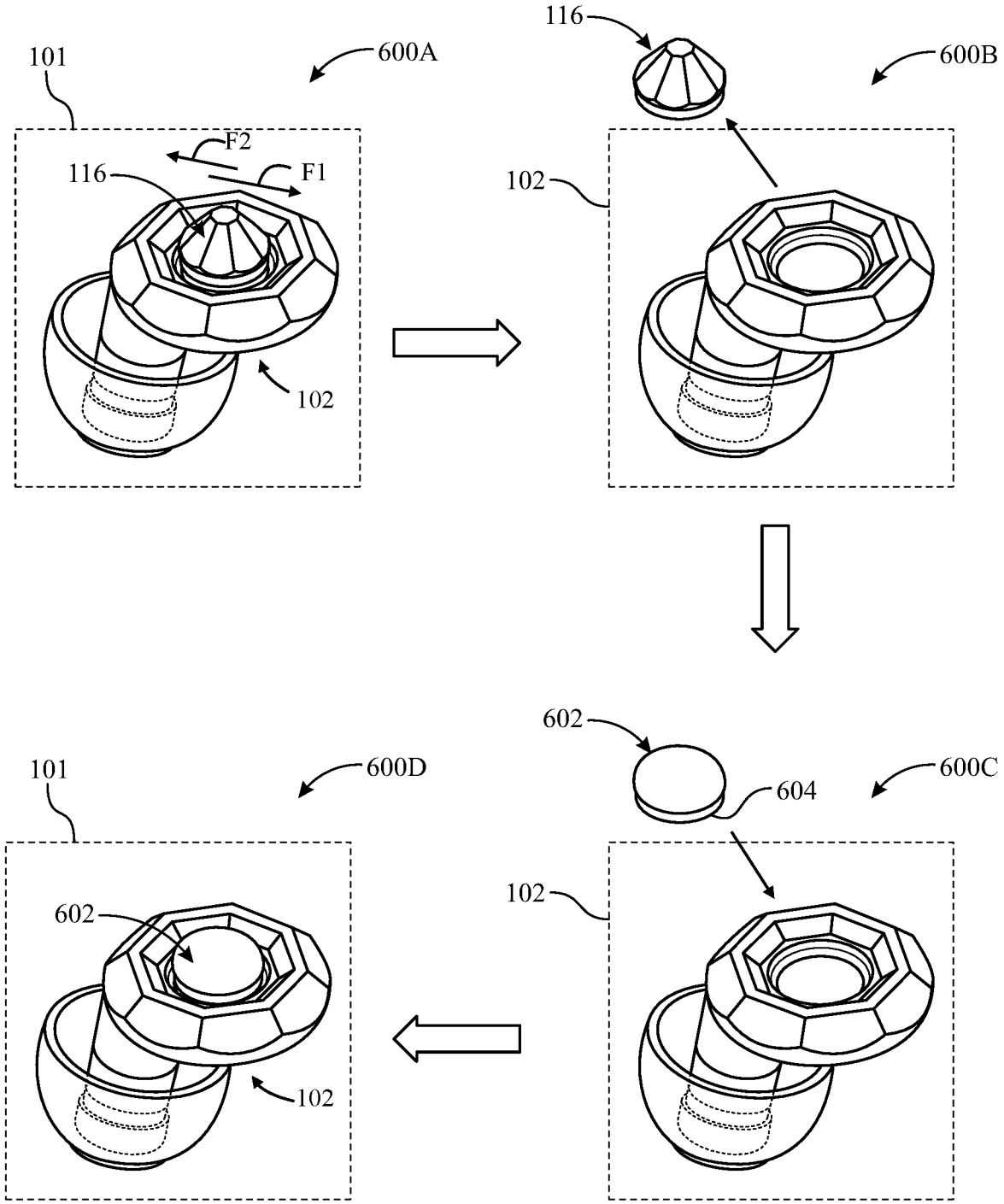
FIG. 6 depicts an exemplary scenario for personalizing an in-ear device, according to an embodiment of the present disclosure.

Whenever the user wants to change the look of the in-ear device 101, all the user is required to do is to magnetically decouple and detach the decorative article 116 from the recess portion 112A of the faceplate 110 and replace the decorative article 116 with a desired decorative article with corresponding ornamental part having another metal coupling plate. The overall arrangement of the desired decorative article is similar to the arrangement of the decorative article 116, as depicted in FIG. 6.

Figure 3A:
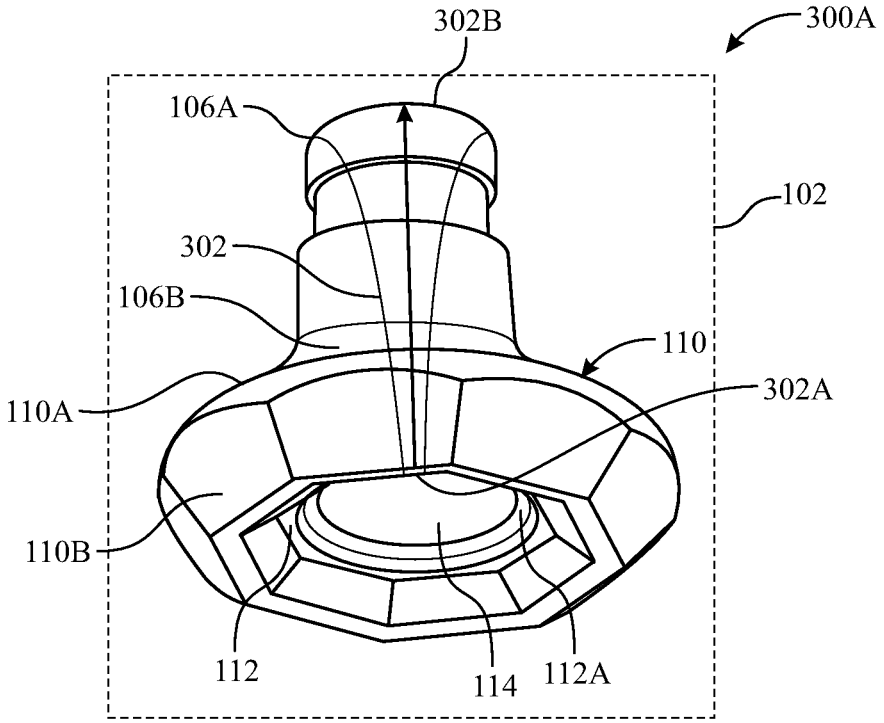
FIG. 3A depicts a perspective view of an in-ear device with an attenuation filter, according to an embodiment of the present disclosure.
Figure 3B:
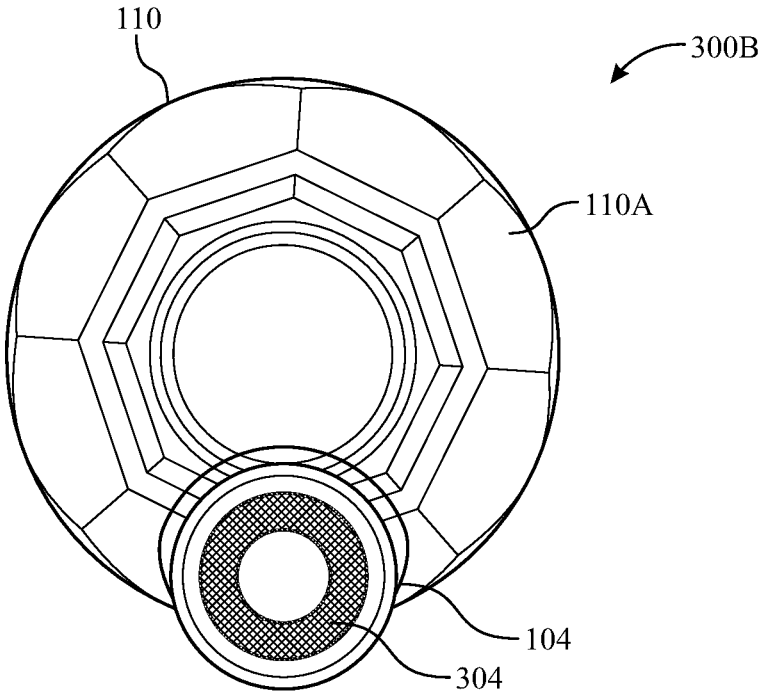
FIG. 3B depicts a top view of an in-ear device with an attenuation filter, according to an embodiment of the present disclosure.

FIGS. 3A and 3B illustrates a perspective view 300A and a top view 300B respectively, of the in-ear device 101 with an attenuation filter, according to an embodiment of the present disclosure. As depicted in FIG. 3A, the in-ear device 101 may further include a sound channel 302 (having a first end 302A and a second end 302B) and a filter, such as an attenuation filter 304.

The sound channel 302 may correspond to a through-hole that creates an air column to pass through the earbud 102. The air column, which runs through the ear canal insert portion 106 and the faceplate 110, allows the ambient sound to pass through the earbud 102 and reach the ear drum 216 of the user wearing the in-ear device 101. In accordance with an embodiment, the first end 302A of the sound channel 302 initiates as a tiny aperture from the second planar region 110B of the faceplate 110. A second end 302B of the sound channel 302 terminates as a wide aperture at the first end 106A, i.e. the tip portion, of the ear canal insert portion 106 that is proximate to the ear drum 216. In accordance with an embodiment, the shape of the sound channel 302 may be a conical shape and the diameter of the tiny aperture at the first end 302A of the sound channel 302 is substantially smaller than the diameter of the wide aperture at the second end 302B of the sound channel 302. It should be noted that in certain embodiments, the shape of the sound channel 302 may also be cylindrical, without any deviation from the scope of the disclosure.

The attenuation filter 304 may comprise a filter medium that may be configured to filter the incoming sound waves for certain decibel levels and certain frequency bands. More specifically, the attenuation filter 304 may be adapted to control a sound pressure level (SPL) of the incoming sound waves (from the ambient sound sources) reaching the ear drum 216 of the user through the sound channel 302. Such attenuation may be required where less than maximum hearing protection is required. For example, substantially loud sounds of high SPL, like blasts or heavy machinery, must be completely blocked. However, feeble sounds of low SPL, like another person talking or an alarm sounding, must remain unblocked.

In accordance with an embodiment, the attenuation filter 304 may be fitted at the second end 302B of the sound channel 302. The attenuation filter 304 may include a mesh member and a filter medium that may correspond to one or more ultra-thin perforated disks with one or more tiny holes. Non-limiting examples of type of materials used to form the filter medium may include glass, ceramic, a metal or an alloy (for example, stainless steel, aluminum, and the like), or plastic (for example, polyvinyl chloride, polycarbonate, nylon, polyurethane, polyoxmethylene, polyethylene, polypropylene, or silicon).

In accordance with various embodiments, the filter medium of the attenuation filter 304 may include a planar disk or a non-planar disk (such as convex, concave, or other shape) to optimize the dissipation of the incoming sound wave. In such embodiments, the incoming sound waves entering from the first end of the sound channel 302 and travelling along the sound channel 302 may reflect off the filter medium (i.e., the planar or non-planar disk) of the attenuation filter 304 and dissipate the energy of the sound wave.

In accordance with an embodiment, such disks may be coupled with a diaphragm member that may be highly flexible and may flex due to an incident sound pressure. The diaphragm member may be made of, for example, Teflon foil or extremely thin polyethylene. As known in the art, the sound pressure in the ear canal 214 ($P_{ear}$) may be related to an SPL of incoming sound waves ($P_{ISW}$), based on the following expression:

$$P_{ear}=P_{ISW}\{C_A/(C_A+C_{ear})\}$$

where, $C_A$ corresponds to compliance value of the diaphragm member, and $C_{ear}$ corresponds to compliance value of the ear 200.

Accordingly, attenuation value (A) provided by the attenuation filter 304 may be computed in decibels (dB), based on the following expression:

$$A=20*\log(P_{ear}/P_{ISW}) \text{ or } 20*\log\{C_A/(C_A+C_{ear})\}$$

As apparent from the above expressions, a smaller value for the compliance value of the diaphragm member ($C_A$) may lead to a smaller pressure within the ear canal 214. In other words, smaller value for the compliance value of the diaphragm member ($C_A$) may indicate a stiffer diaphragm member and a greater value of attenuation.

In accordance with various embodiment, when the SPL of the incoming sound waves is below the first threshold value, the diaphragm member may flex with a change in sound pressure, and attenuate the incoming sound waves at a constant and relatively lower values. When the SPL of the incoming sound waves exceeds beyond the second threshold value, the sound pressure causes the diaphragm member to flex to a point where it is impeded by the interior walls of the disks. Thus, the limited flexibility of the diaphragm member may substantially reduce the acoustical compliance of the diaphragm member and dramatically increase the attenuation value. Accordingly, extremely loud sounds may be fully attenuated or completely blocked by the attenuation filter 304.

Thus, the attenuation provided by the attenuation filter 304 may vary based on the one or more parameters of the attenuation filter 304 of the in-ear device 101. The one or more parameters may include, but not limited to, the type of the material of filter medium of the attenuation filter 304 (as described above), flexibility of the diaphragm member (as described above), a structure of the filter medium (as described above), and pore size (preferably between 1 to 500 μm) of the filter medium.

In accordance with an embodiment, based on the one or more parameters of the attenuation filter 304, the attenuation filter 304 may generate a zero or minimal attenuation effect when the SPL of the incoming sound waves is below a first threshold value. In such embodiment, the SPL of the incoming sound waves may correspond to low-range sounds (for example, less than 80 dB). Thus, the SPL of filtered sound waves may substantially remain same as the SPL of incoming sound waves. For example, for low-range sound sources, such as a two persons talking to each other or an alarm sounding, the attenuation filter 304 provides zero or minimal attenuation.

In accordance with another embodiment, based on the one or more parameters of the attenuation filter 304, the attenuation filter 304 may generate a full attenuation effect when the SPL of the incoming sound waves is above a second threshold value. In such embodiment, the SPL of the incoming sound waves may correspond to high-range sounds (for example, higher than 120 dB). Thus, the SPL of filtered sound waves may become zero, i.e. the high-range sounds are completely blocked. For example, for high-range sounds source, such as blasts, gun shots, heavy-load machines, airports, or demolition and construction sites) the attenuation filter 304 provides highest level of attenuation and blocks the sounds.

In accordance with another embodiment, based on the one or more parameters of the attenuation filter 304, the attenuation filter 304 may generate an intermediate attenuation effect when the SPL of the incoming sound waves is between the first and the second threshold values.

In such embodiment, the SPL of the incoming sound waves may correspond to mid-range sounds (for example, between 80 and 120 dB). Thus, the SPL of filtered sound waves may be substantially reduced. For example, for mid-range sound sources, such as a crowded market, a stadium, or a concert, the attenuation filter 304 provides intermediate attenuation by partially blocking high intensity sound waves and allowing low range sound waves.

It may be noted that the above ranges are cited merely for exemplary purposes and may not be construed to limit the scope of the disclosure.

Figure 4:
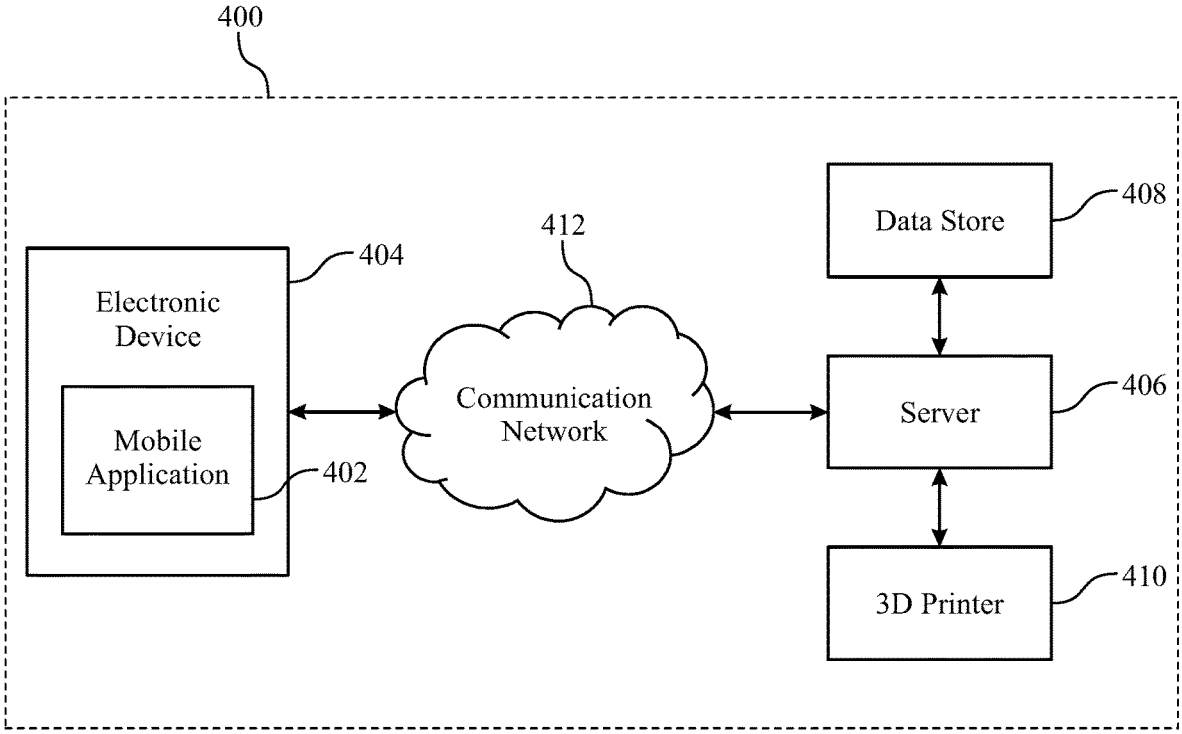
FIG. 4 depicts a computer implemented system for producing a personalized one or more parts of an in-ear device, according to an embodiment of the present disclosure.

FIG. 4 depicts a computer implemented system 400 for producing a personalized one or more parts of the in-ear device 101, according to an embodiment of the present disclosure. The one or more parts may include the ear plug 108 and the earbud 102. The additional components, such as the first metal coupling plate 114, the attenuation filter 304, and optional electronics system may be fixed inside, mounted on, and/or embedded in or on the body of the ear canal insert portion 106 of the earbud 102 once the earbud 102 is produced.

The computer implemented system 400 may comprise a mobile application 402 and an electronic device 404. The mobile application 402 may be launched from the electronic device 404, such as a smartphone, and may be used to capture multiple images or video clips of both the ears of the user.

The computer implemented system 400 may comprise a server 406. The server 406 may include any hardware, software, firmware, or combination thereof that may be operable to perform one or more functions for producing the personalized one or more parts of the in-ear device 101. The server 406 may be further configured to generate a 3D model that defines not only an exterior surface of the earbud 102, but also the interior surface forming a sound channel.

The computer implemented system 400 may further comprise a data store 408. The data store 408 may include any hardware, software, firmware, or combination thereof that may be operable to store and facilitate retrieval of information, such as images, video clips, and 3D models generated by the server 406. The computer implemented system 400 may further comprise a 3D printer 410 that may be programmed to print the 3D model generated by the server 406 directly in the material, such as plastic or silicone. The computer implemented system 400 may further comprise a communication network 412 that may include one or more local area networks (LANs), metropolitan area networks (MANs), wide area networks (WANs), all and/or a portion of a global network, such as the Internet, or any other communication system or systems at one or more locations. The communication network 412 may facilitate communication between various components of the computer implemented system 400 for producing the personalized one or more parts of the in-ear device 101.

In operation, the electronic device 404, via the mobile application 402, may be configured to capture multiple images or video clips of the pair of ears of the user. The electronic device 404 may be further configured to transmit the captured images or the video clips to the server 406 via the communication network 412. The server 406 may be further configured to processes the images or the video clips to create a 3D dimensional model of the pair of ears of the user based on known techniques, such as photogrammetry analysis, and then another 3D model of the personalized one or more parts of in-ear device 101, which may be secured comfortably in the ears. The server 406 may be configured to store the received images, the video clips, the 3D dimensional model of the pair of ears of the user, and the 3D model of the personalized one or more parts of the in-ear device 101 in the data store 408. The data store 408 coupled to the server 406 may store the aforesaid data and related information, such as user details, user preferences, and the like. The server 406 may be further configured to transmit the 3D model of the personalized one or more parts of the in-ear device 101, to the 3D printer 410 via the communication network 412. The 3D printer 410 may be configured to generate the personalized one or more parts of the in-ear device 101, based on the images or the video clips of the pair of ears of the user.

In accordance with an alternate embodiment, the shape of the ear may be determined by taking an impression of the ear by inserting soft silicone, which is different from the silicone used to make the ear plug 108. Having obtained the ear impression, there may be several ways to manufacture the one or more parts of the in-ear device 101. The silicon ear impression may be digitally scanned to create the 3D model. In accordance with an embodiment, the 3D model may be used with the 3D printer 410 to make a plastic mould, which may be then filled with relevant material, such as silicone and plastic, to separately make the ear plug 108 and the earbud 102. However, the disclosure may not be so limited and other alternate materials of similar characteristics as of silicone and plastic may be used to produce the ear plug 108 and the earbud 102 respectively, without any deviation from the scope of the disclosure. Further, in certain embodiments, the material used for producing the ear plug 108 and the earbud 102 may be the same. In such embodiments, the characteristics of the material may be an intermediate of silicone and plastic characteristics such that the in-ear device 101 is both comfortable and sturdy at the same time. In yet other embodiments, two different types of silicone, of different hardness, may be used, for the ear plug 108 and the earbud 102. The result of the moulding process is a single solid body of the in-ear device 101 formed of silicone.

In accordance with an embodiment, the sound channel 302 may be designed in conjunction with the 3D model of the earbud 102, using a known computer 3D modelling software. In such embodiment, the 3D model in the computer defines not only the exterior surface of the body of the earbud 102, but also the interior surface, forming the sound channel 302.

In accordance with an embodiment, after the one or more parts of the in-ear device 101 is produced in the desired shape (including the sound channel 302), the earbud 102 may be coated with a sealant, such as a lacquer, to make the earbud 102 more comfortable and reduce the sound absorption properties of the material used. One example of a suitable lacquer may be Abdrucklack™ used as a silicone sealant.

Thus, personalized in-ear device 101 may be customized, designed and produced to suitably fit into the ears of the user. Further, the personalized in-ear device 101 may be in accordance with the desired material, model and style, fitting preferences, ergonomic preferences, aesthetic preferences, activity preferences, soundscaping preferences of the user. Furthermore, the personalized in-ear device 101 may provide the user with various options for add-on capabilities as well as options to design or purchase matching accessories or apparels to be integrated with the personalized in-ear device 101.

Figure 5:
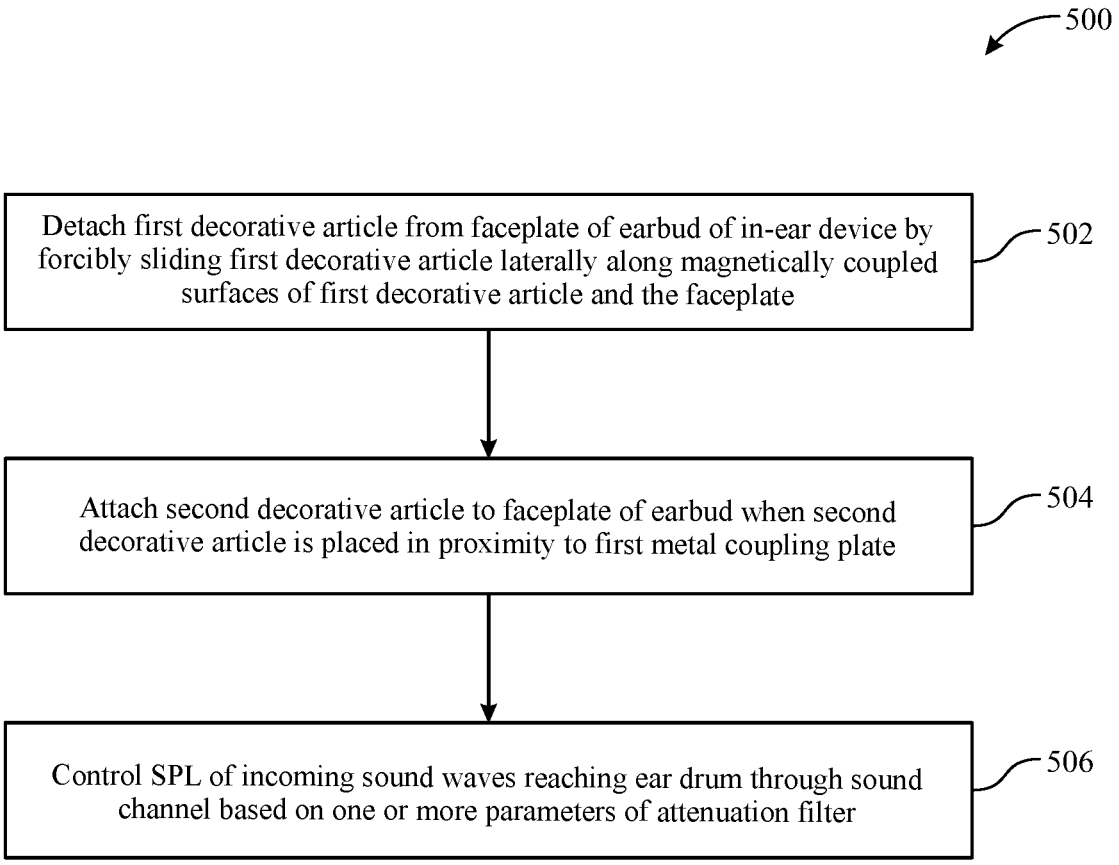
FIG. 5 depicts a flowchart illustrating exemplary operations for handling an in-ear device, according to an embodiment of the present disclosure.

FIG. 5 depicts a flowchart 500 illustrating exemplary operations for handling the in-ear device 101, according to an embodiment of the present disclosure. FIG. 5 is described in conjunction with FIGS. 1A, 1B, 2A, 2B, 3A, 3B, and 4, according to various embodiment of the present disclosure. FIG. 5 is further described in conjunction with FIG. 6 which depicts an exemplary scenario 600 for personalizing an in-ear device, such as the in-ear device 101, according to an embodiment of the present disclosure.

At 502, a first decorative article, such as the decorative article 116, may be detached from the faceplate 110 of the earbud 102 of the in-ear device 101 by forcibly sliding the first decorative article, i.e. the decorative article 116, laterally along magnetically coupled surfaces of the first decorative article, i.e. the decorative article 116, and the faceplate 110. The forcibly sliding action may be one of a pulling action, depicted by F1, by or pushing action, depicted by F2, laterally along magnetically coupled surfaces of the first decorative article, i.e. the decorative article 116, and the faceplate 110. Such sliding action may be provided by the user by using one of the fingertips, finger nails, or an external object, such as a spatula, which reduces the magnetic resistance and then the first decorative article, i.e. the decorative article 116, may be detached easily.

The first magnetically coupled surface may correspond to the first metal coupling plate 114 housed in the recess portion 112*a* of the second planar region 110B of the faceplate 110. The second magnetically coupled surface may correspond to the second metal coupling plate 120 at a base of the first decorative article, i.e. the decorative article 116. In accordance with an embodiment, one of the first metal coupling plate 114 and the second metal coupling plate 120 is a magnetic material and the other is an armature. In accordance with another embodiment, both of the first metal coupling plate 114 and the second metal coupling plate 120 may be magnetic materials with surfaces of opposite polarities facing each other.

As depicted in a first perspective view 600A, the first decorative article, i.e. the decorative article 116, may be coupled with the earbud 102. As the user desires to replace the first decorative article, i.e. the decorative article 116, with a second decorative article 602, the user may perform a forcibly sliding action, such as a pulling or pushing action, laterally along magnetically coupled surfaces of the first decorative article, i.e. the decorative article 116, and the faceplate 110, and detach the first decorative article, i.e. the decorative article 116, from the earbud 102, as depicted in a second perspective view 600B.

At 504, a second decorative article 602, that the user may desire to replace with the first decorative article, i.e. the decorative article 116, may be attached to the faceplate 110 of the earbud 102 when the second decorative article 602 is placed in proximity to the first metal coupling plate 114. The structure of the second decorative article 602 may be similar to the structure of the first decorative article, i.e. the decorative article 116. The first metal coupling plate 114 may be magnetically coupled with a third metal coupling plate 604 of the second decorative article 602, as depicted in a third perspective view 600C.

Once the first decorative article, i.e. the decorative article 116, is replaced with the second decorative article 602, as depicted in a fourth perspective view 600D, the personalized in-ear device 101 may be ready to be used. The user may wear the personalized in-ear device 101 in the ear 200 such that the head portion 104 of the earbud 102 is secured in the ear 200 of the user by snuggly fitting the ear plug 108 inside the ear canal 214 of the ear 200. The faceplate 110 of the earbud 102 protrudes out and snuggly fits in the cavum concha of the ear 200. The faceplate 110 traversely extends from a base, i.e. the second end 106B, of the ear canal insert portion 106 to an area that is proximate to an outer boundary of the first planar region 110A of the faceplate 110.

In accordance with an embodiment, a clicking sound may be generated as one of the third metal coupling plate 604 of the second decorative article 602, i.e. the desired decorative article, is magnetically coupled to the first metal coupling plate 114. The clicking sound may be similar to the clicking sound generated during the magnetic coupling of the second metal coupling plate 120 of the first decorative article, i.e. the decorative article 116, with the first metal coupling plate 114. The metal coupling plate 120 may also be a casing that the decorative article 116 is attached to, where the casing can attract a magnet, or be a magnet. The casing may be a cylindrical casing along the sides and/or bottom, surrounding the decorative article 116.

At 506, the SPL of the incoming sound waves reaching the ear drum 216 through the sound channel 302 may be controlled based on one or more parameters of the attenuation filter 304 once the user wears the in-ear device 101 in the ear 200. Non-limiting examples of the one or more parameters of the attenuation filter 304 may comprise a type of material of the filter medium of the attenuation filter 304, a structure of the filter medium, flexibility of a diaphragm member, and pore size of the filter medium.

In accordance with an embodiment, the attenuation filter 304 may be configured to generate a zero attenuation effect when the SPL of the incoming sound waves is below a first threshold value. In accordance with another embodiment, the attenuation filter 304 may be configured to generate a full attenuation effect when the SPL of the incoming sound waves is above a second threshold value. In accordance with yet another embodiment, the attenuation filter 304 may be configured to generate a partial attenuation effect when the SPL of the incoming sound waves is between the first threshold value and the second threshold value.

The embodiments provide for several advantages over the prior art. For example, existing in-ear devices lack aesthetics appeal and limit the users to very selective designs, fixed accessories (such as jewels), and monochrome colors and do not provide any option of personalizing the devices. On the other hand, the in-ear device 101, in accordance with various embodiments of the disclosure, score high on personal aesthetics as the in-ear device 101 facilitates magnetic interchangeability of the decorative article 116. The decorative article 116 is so simply, securely and easily interchangeable that a hassle-free customization of the in-ear device 101 is provided to the user on-the-go. Thus, the in-ear device 101 easily satisfies the quest of the user to find a right colored or accessorized in-ear device 101 to match the mood or the overall look.

In addition to being highly customizable, the in-ear device 101 is also extremely cost effective as there is no added cost of acquiring different in-ear devices with different decorative embellishments. The user requires only one pair of earbuds 102 and different pairs of decorative articles, such as the decorative article 116, that provide different looks to the in-ear device 101 to meet each wardrobe, home decor, and social event requirement. Such different pairs of decorative articles are small, thus, safekeeping of such in-ear device is hassle-free and the user is required to only stow the decorative articles in small handy pouch/pack. Thus, it becomes easy for the user to very conveniently carry along different pairs of decorative articles in his/her handbag all-the-time and interchange the decorative article 116 while at work or travelling. Thus, the user is relieved from the additional time-consuming task to safely secure different costly in-ear devices separately as they occupy larger space and can't be carried along everywhere.

Further, the in-ear device 101 with the decorative article 116 can be easily worn by the user. The compact design of the in-ear device 101 snuggly fits in the ear and makes the in-ear device 101 a comfortable and trendy wear. Thus, the in-ear device 101 provides ease of use, security of the connections, and cost-effectiveness, and personalized aesthetics, all at the same time.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

What is claimed is:

1. An in-ear device comprising:

a) a head portion of an earbud having an ear canal insert portion and an ear plug, wherein a first end of the ear canal insert portion coupled with the ear plug;

b) a faceplate of the earbud having a first planar region and a second planar region, wherein the first planar region is traversely extended from a second end of the ear canal insert portion to an area that is proximate to an outer boundary of the first planar region, wherein the second planar region of the faceplate corresponds to a mounting region that has a recess portion adapted to house a first metal coupling plate; and, c) a decorative article detachable from the mounting region, wherein the decorative article has a second metal coupling plate, wherein at least one of the first metal coupling plate and the second metal coupling plate is a magnetic material, wherein the first metal coupling plate in the recess portion is complementarily sized and shaped to magnetically couple with the second metal coupling plate of the decorative article when placed in proximity to the first metal coupling plate of the faceplate of the earbud.

2. The in-ear device according to claim 1, wherein the first end of the ear canal insert portion coupled with the ear plug and having an attenuation filter is disposed proximate to an ear drum of a user, wherein the attenuation filter is adapted to control a sound pressure level (SPL) of incoming sound waves reaching the ear drum through a sound channel based on one or more parameters of the attenuation filter, wherein the one or more parameters of the attenuation filter comprise a type of material of a filter medium of the attenuation filter, a structure of the filter medium, flexibility of a diaphragm member, and pore size of the filter medium.

3. The in-ear device according to claim 2, wherein the attenuation filter generates a zero attenuation effect when the SPL of the incoming sound waves is below a first threshold value.

4. The in-ear device according to claim 2, wherein the attenuation filter generates a full attenuation effect when the SPL of the incoming sound waves is above a second threshold value.

5. The in-ear device according to claim 2, wherein the attenuation filter generates a partial attenuation effect when the SPL of the incoming sound waves is between a first threshold value and a second threshold value.

6. The in-ear device according to claim 1, wherein the head portion houses an electronics system communicatively coupled with external devices, and wherein the faceplate of the earbud protrudes out and snuggly fits in cavum concha of an ear.

7. The in-ear device according to claim 1, wherein the decorative article is a gem stone, a jewel, a metallic object, or other magnetic artifact.

8. The in-ear device according to claim 1, wherein a clicking sound is generated as the second metal coupling plate of the decorative article is magnetically coupled to the first metal coupling plate.

9. The in-ear device according to claim 1, wherein the ear plug corresponds to a resilient membrane tip, wherein size and shape of the ear plug is substantially deformed and subsequently expanded resiliently to fit different ear canal sizes and shapes.

10. The in-ear device according to claim 1, wherein a plate size and a plate shape of the first metal coupling plate is based on a shape and size of the recess portion.

11. A method for an in-ear device with personalized aesthetics, the method comprising:

detaching a first decorative article from a faceplate of an earbud of the in-ear device by forcibly sliding the first decorative article laterally along magnetically coupled surfaces of the first decorative article and the faceplate, wherein a first magnetically coupled surface corresponds to a first metal coupling plate housed in a recess portion of a second planar region of the faceplate, wherein a second magnetically coupled surface corresponds to a second metal coupling plate at base of the first decorative article, wherein at least one of the first metal coupling plate and the second metal coupling plate is a magnetic material; and, attaching a second decorative article to the faceplate of the earbud when the second decorative article is placed in proximity to the first metal coupling plate, wherein the first metal coupling plate is magnetically coupled with a third metal coupling plate of the second decorative article.

12. The method according to claim 11, further comprising controlling a sound pressure level (SPL) of incoming sound waves reaching an ear drum through a sound channel based on one or more parameters of an attenuation filter of the in-ear device.

13. The method according to claim 12, wherein the one or more parameters of the attenuation filter comprise a type of material of a filter medium of the attenuation filter, a structure of the filter medium, flexibility of a diaphragm member, and pore size of the filter medium.

14. The method according to claim 12, wherein the attenuation filter generates a zero attenuation effect when the SPL of the incoming sound waves is below a first threshold value.

15. The method according to claim 12, wherein the attenuation filter generates a full attenuation effect when the SPL of the incoming sound waves is above a second threshold value.

16. The method according to claim 12, wherein the attenuation filter generates a partial attenuation effect when the SPL of the incoming sound waves is between a first threshold value and a second threshold value.

17. The method according to claim 11, wherein a head portion of the earbud is secured in an ear of a user by snuggly fitting an ear plug inside an ear canal of the ear, wherein the ear plug is coupled with a first end of an ear canal insert portion of the head portion, wherein the faceplate of the earbud protrudes out and snuggly fits in cavum concha of the ear, wherein the faceplate traversely extends from a second end of the ear canal insert portion to an area that is proximate to an outer boundary of a first planar region of the faceplate.

18. The method according to claim 17, wherein the ear plug corresponds to a resilient membrane tip.

19. The method according to claim 17, wherein size and shape of the ear plug is substantially deformed and subsequently expanded resiliently to fit different ear canal sizes and shapes, wherein the head portion houses an electronics system communicatively coupled with external devices.

20. The method according to claim 11, further comprising generating a clicking sound when one of the second metal coupling plate of the first decorative article or a third coupling plate of the second decorative article is magnetically coupled to the first metal coupling plate.

* * * * *